United States Patent [19]

Doyle et al.

[11] Patent Number: 4,724,009

[45] Date of Patent: Feb. 9, 1988

[54] METHOD AND APPARATUS FOR CLEANING REELS

[76] Inventors: John R. Doyle, Rte. 7, Cline Rd.; Dale G. Stover, 3 Skyview Cir., both of Cartersville, Ga. 30120

[21] Appl. No.: 848,247

[22] Filed: Apr. 4, 1986

[51] Int. Cl.[4] ..... B08B 9/00; B08B 9/04; B08B 3/04

[52] U.S. Cl. ..... 134/22.1; 134/25.1; 134/25.4; 134/75; 134/134

[58] Field of Search ..... 134/48, 52, 70, 73, 134/75, 78, 82, 83, 124, 125, 126, 128, 71, 22.1, 25.1, 25.4, 134; 198/465.3, 681, 803.2, 803.8, 803.14; 414/684, 910, 911

[56] References Cited

U.S. PATENT DOCUMENTS

| | | | |
|---|---|---|---|
| 1,556,045 | 10/1925 | Swain et al. | 134/73 |
| 2,811,163 | 10/1957 | Weber et al. | 134/125 |
| 4,375,992 | 3/1983 | Stevens et al. | 134/104 |

*Primary Examiner*—Harvey C. Hornsby
*Assistant Examiner*—Corinne M. Reinckens

[57] ABSTRACT

Apparatus for cleaning reels comprises a set of vats mounted in tandem provided with a track over which reels may be rolled successively through the vats. An endless conveyor extends along the series of vats from which resilient grab arms are pivotably suspended. The arms are provided with sockets to capture opposite ends of the reel axles. Cam rods are provided for guiding the sockets into and out of positions of axial alignment with the reel axles to effect reel pickup and release.

11 Claims, 12 Drawing Figures

METHOD AND APPARATUS FOR CLEANING REELS

TECHNICAL FIELD

This invention relates to methods and apparatuses for cleaning reels, spools and the like.

BACKGROUND OF THE INVENTION

Industrial reels and spools used to support material convoluted thereabout become dirty in time as material is wound onto and off of the reels. For example, aluminum reels used to carry fibers, like that used in manufacturing tires, become dulled and solid with use. Such reels may be cleansed, as with heated chlorinated hydrocarbon solvents like perchloroethylene, and brightened with acid. However, to clean large numbers of reels by submerging them in cleansing solutions and then thoroughly rinsing them, such must be done on an automated basis for efficiency and economy of operations.

Heretofore, procedures and apparatuses have been devised for cleaning articles by submerging them in succession in a series of vats or open top tanks that house different cleansing agents. For example, U.S. Pat. No. 797,298 discloses apparatus for cleaning and sterilizing bottles in which the bottles are mounted upon a conveyor belt that passes through a series of tanks along a serpentine path. In U.S. Pat. No. 3,894,197 workpieces are passed successively through a series of tanks while supported upon carriers driven by an endless conveyor over the top of the tanks that raise and lower the workpieces into each tank as it is positioned thereabove.

The just described types of systems and methods for cleansing bottles that may be placed snuggly together, and workpieces supported upon platforms, are not readily adaptable for use in cleaning reels. Individual reels could be upended upon their flanges and supported upon platforms, but such would normally require manual labor for loading and unloading. Also, many reels have axial projections or rounded flanges which renders it difficult to support them in an upended configuration. To support the reels upon the edges of their annular flanges would require the use of restraining means to hold them in place. Such would also tend to leave their area of support contact not adequately cleansed.

Accordingly, it is seen that a need remains for methods and apparatuses for cleaning reels, spools and the like on an automated basis. It is to the provision of such methods and apparatuses that the present invention is therefore primarily directed.

SUMMARY OF THE INVENTION

In one form of the invention apparatus for cleaning reels comprises a plurality of vats mounted in tandem in which a plurality of liquid cleansing agents may be separately applied. Conveyor means extend along the vats to which at least one pair of resilient arms is mounted which are provided with sockets that face one another and which are spaced apart a distance for holding opposite ends of axle of a reel located therebetween. The arms are provided with camming surfaces for spreading the resilient arm sockets apart upon contact with the reel axle and for releasing them so as to capture and hold the axle ends at a reel pickup station, and for spreading the axial arm sockets apart so as to release them from the axle ends upon contact with a camming bar at a reel discharge station.

In another form of the invention apparatus for cleaning reels of a type having projections extending outwardly from their flanges comprises at least one vat adapted to receive a cleansing liquid agent, conveyor means extending along a path of travel adjacent the vat, and at least one arm suspended from the conveyor means which is provided with a socket for holding an end of a reel projection. A stop bar is mounted at the pickup station to engage the arm as it is conveyed through the pickup station and guide the arm socket into alignment with the reel projection while the reel is located at the pickup station for capturing and holding the reel projection. Another bar is mounted at a reel discharge station to engage the arm as it is conveyed through the discharge station and to cam it axially outwardly from the reel so as to release the arm socket from the reel projection.

In yet another form of the invention apparatus for cleaning reels comprises a set of vats arranged in tandem having serpentine track means upon which reels may be rolled successively therethrough. Endless conveyor means extend generally linerally along the set of vats. Grab arm means are pivotably suspended from the conveyor means for drawing reels successively through the vats upon the serpentine track means.

In still another form of the invention a method of cleaning reels comprises the steps of positioning a reel at a reel pickup station located at one end of a series of vats arranged in tandem along which an endless conveyor chain is driven. A pair of pickup arms pivotably suspended from the conveyor chain is brought into engagement with projections that project coaxially outwardly from the reel flanges. The reel is drawn by the pair of arms from the pickup station successively through the vats while a liquid cleansing agent is applied to the reel while passing through each vat. The pickup arms are released from the reel projections at a reel discharge station located at the opposite end of the series of vats.

BRIEF DESCRIPTION OF THE DRAWING

FIG. 2 is a side elevational view of a reel pickup end portion and a mid-portion of the apparatus shown in FIG. 1 while

DETAILED DESCRIPTION

Figure 1:
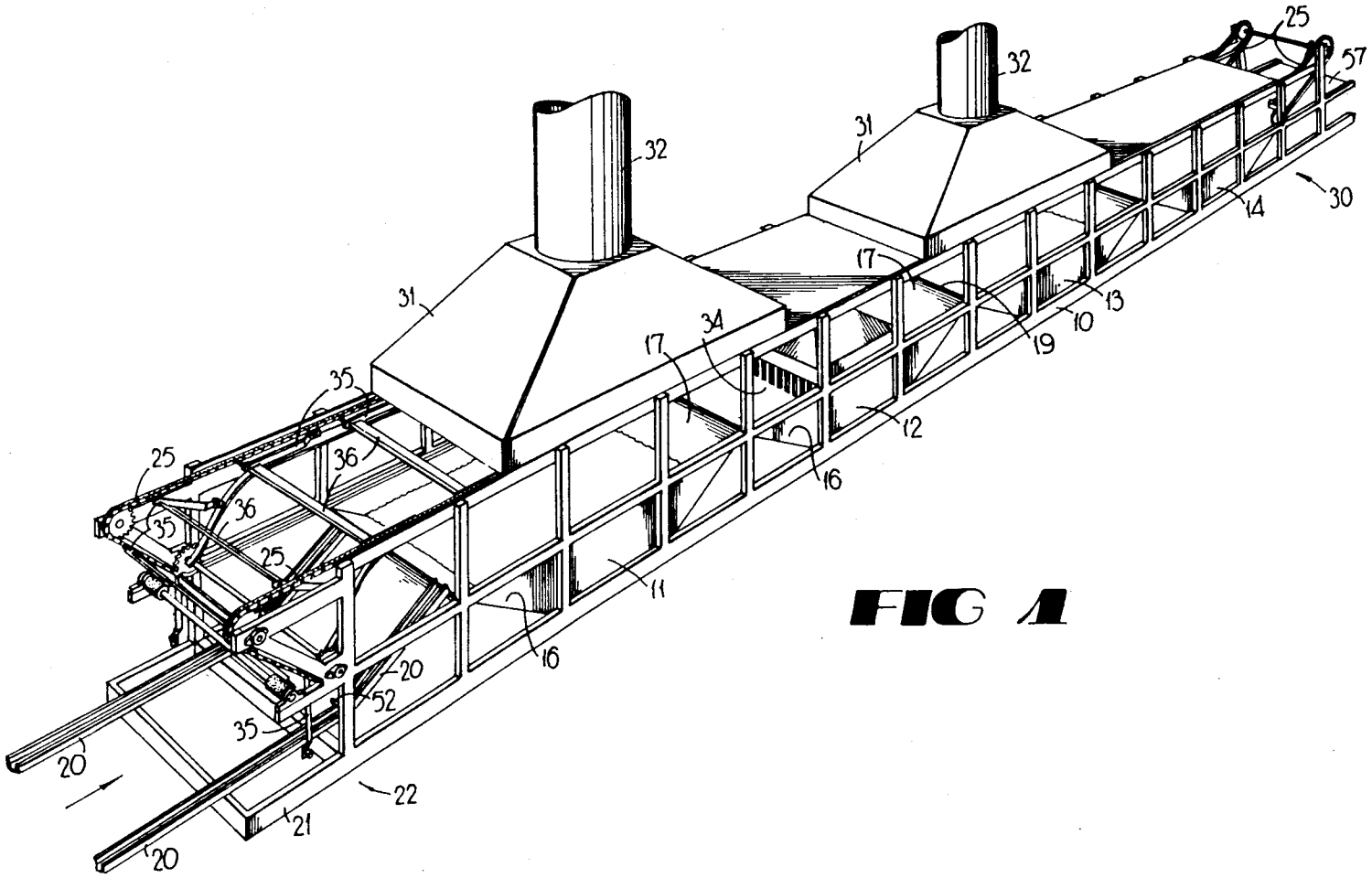
FIG. 1 is a perspective view of apparatus for cleaning reels which embodies principles of the present invention.
Figure 2A:
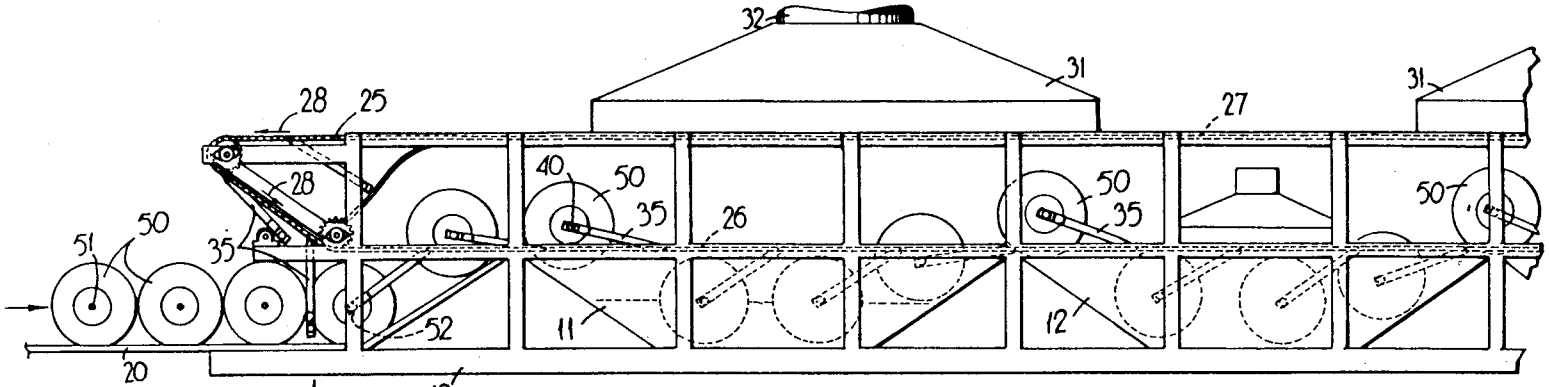
Figure 2B:
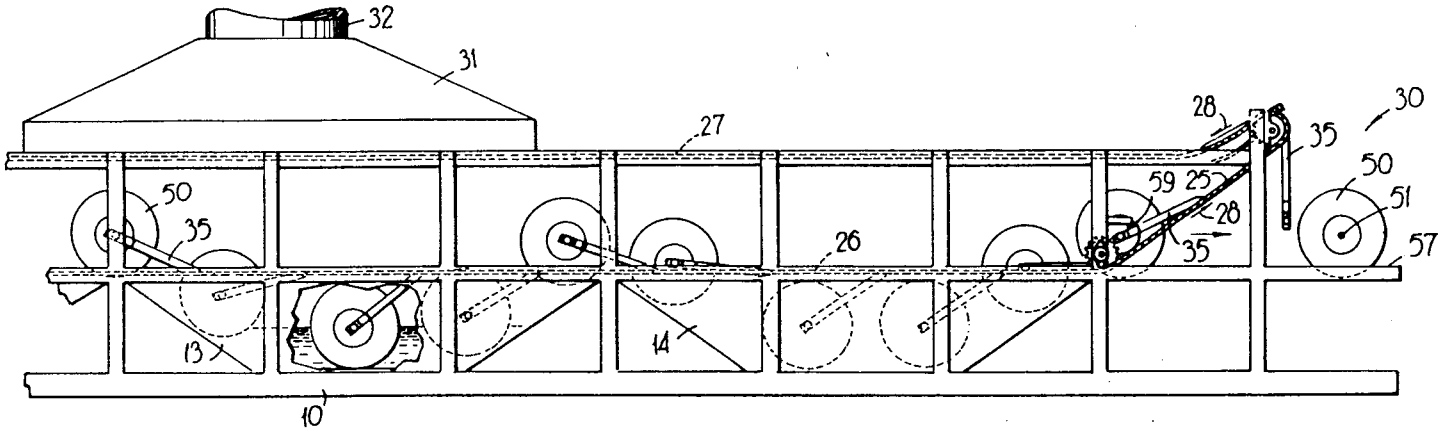
FIG. 2B is a side elevational view of a reel discharge end portion and a mid-portion of the apparatus.

With reference next to the drawing, there is shown in FIGS. 1 and 2 reel cleaning apparatus that comprises a frame, indicated generally at 10, upon which four open top vats or tanks 11–14 are sequentially mounted in tandem. Means, largely unshown, are provided for supplying cleaning liquids to the vats and for draining them. The front wall 16 and the rear wall 17 of each vat are seen to be oriented along inclined planes that converge upon a planar floor of each vat. Adjacent vats have the apexes of their front and rear walls joined together as indicated at 19 in FIG. 1. A track 20 is mounted to the front end 21 of the frame at a very slight incline so that its lowermost point is at a reel pickup station 22. The track extends upwardly from the reel pickup station to terminate at the top of the front wall 16 of the first vat 11.

A conveyor is mounted to the frame 10 for conveying reels successively through the vats 11–14. The conveyor is seen to be comprised of two endless chains 25 mounted to the frame for travel along two mutually parallel, loop-shaped, endless paths. Each of these paths includes a substantially linear, lower path segment 26 located at a height near the top of the vats, and an upper path segment 27 located along the top of the frame 10. Each of the chains is driven in the direction indicated by arrows 28 such that the chains extend downwardly along an inclined path of travel approaching the reel pickup station 22 and extend upwardly along an inclined path of travel leaving a reel discharge station 30. The chains are driven by unshown motor means that is coupled with drive sprockets over which the chains are driven and guided along their respective paths of endless travel. As shown in FIG. 1, the apparatus also has a pair of hoods 31 mounted atop the frame 10 which communicate with vent ducts 32.

The first vat 11 here holds a caustic degreaser, preferably perchloroethylene, heated to some 100 to 120 degrees F. The second vat 12 houses an acidic brightening agent which is sprayed from an array of spray nozzles 34 downwardly within the vat. The third vat 13 holds a liquid rinsing agent while the forth vat 14 houses a spray rinse which is applied from a set of unshown spray nozzles.

Figure 4A:
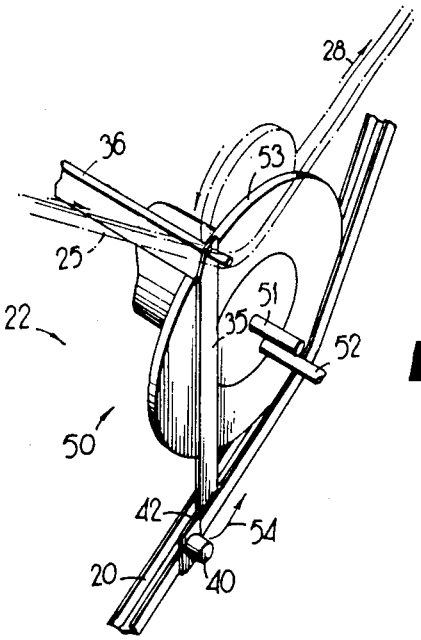
FIGS. 4A–4E illustrate, in perspective, a portion of a reel located at a reel pickup station of the apparatus sequentially in the process of being captured by a pickup arm suspended from an endless conveyor.
Figure 4B:
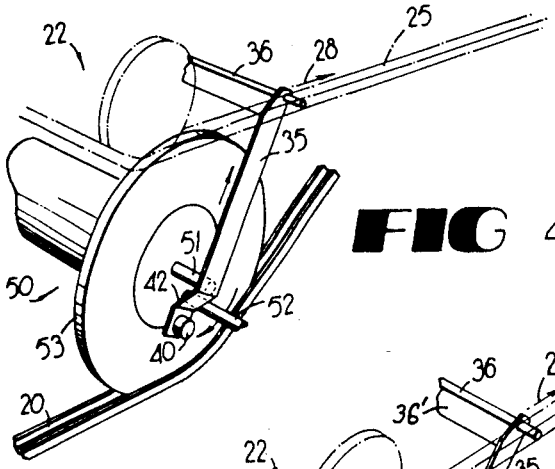
Figure 4C:
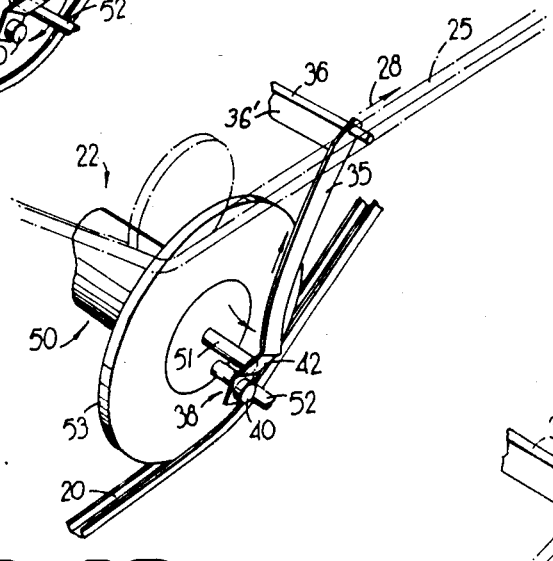
Figure 4E:
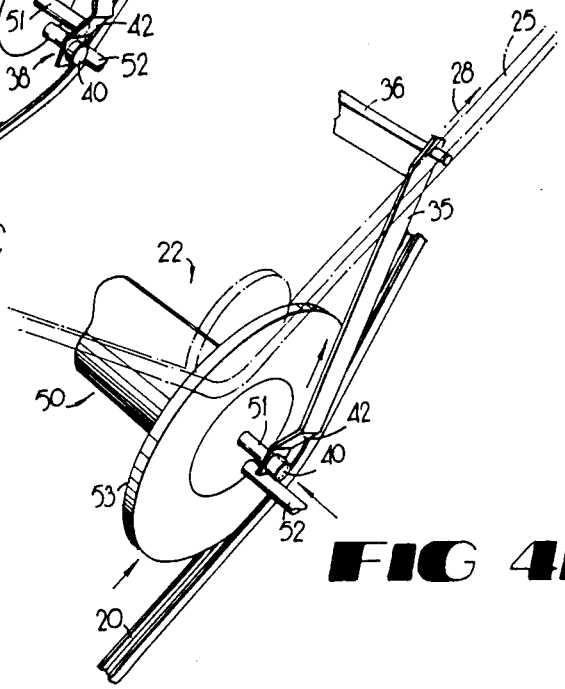
Figure 4D:
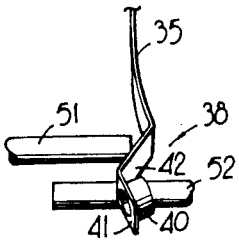

A number of pivot pins 36 are mounted at regular intervals to the pair of endless chains 25 so as to span the spacing between them. A pair of resilient grab arms is pivotably suspended from each pin 36 to straddle a reel. The mounting is such that the arms 35 may rotate and swing freely about the axes of the pivot pins. The upper portions of each arm are substantially planar and are welded to strengthening members or struts 36' that extend from the pins 36. The lower portions of the arms located distal the pivot pins are of a generally stepped configuration. The lower end of each arm, indicated generally at 38 in FIG. 4D, is seen to be formed with a socket 40 that opens inwardly such that the sockets of a pair of arms face each other and are fixed to a common pivot axis. A flat lip or flange 41 about the socket is seen to be unitarily joined to the upper portion of the arm, which is substantially linear in its normal configuration, by a intermediary, camming section 42. This camming section 42 extends angularly from the upper portion of arm 35 to the socket flange portion 41 which extends parallel to the upper arm section.

The reel cleaning apparatus arms 35 are provided for automatically picking up reels located at the reel pickup station 22, for carrying them into and out of the vats 11–14 sequentially, and then for automatically discharging them at the reel discharge station 30. Just how reel pickup is achieved may be best understood by reference to FIGS. 4A–4E. In FIG. 4A a reel, indicated generally at 50, is seen to be resting at and upon the lowermost portion of track 20 at the base or foot of the incline track section with the reel axle 51 located adjacent a guide bar 52 that is rigidly mounted to the frame 10. The annular edge of one reel flange 53 is seen to be held in the track provided by a pair of U-shaped rails. One of the conveyor arms 35 is here seen to be approaching the pickup station 22, in the direction indicated by arrow 54, depending freely downwardly beneath the pivot bar 36. In FIG. 4B it is seen that the pivot bar 36 has now contacted the guide bar 52 and slid upon its side edge over the bar until a side edge of its camming section 42 is now upon the guide bar. As this is done the end of the reel axle 51 is seen to be in close proximity to the linear portion of the arm 35 closely adjacent to and above the intermediary arm camming section 42. As the conveyor advances the pivot bar 36 to the position illustrated in FIG. 4C the arm 35 is pivoted by sliding over the guide bar 52 so as to bring the end of the reel axle 51 now against the intermediary camming section 42 of the arm. As the end of the axle 51 slides upon this intermediary section it forces the upper porition of the bar to arch or flex as shown in FIG. 4C since the top of the arm located about the axle 36 is prevented from making any axial movement along the pivot pin 36 by being rigidly secured to strut 36'. This same position is also shown from another angle in FIG. 4D. Further advancement of the pivot pin 36 by the conveyor causes the end of the end of the reel axle 51 to slide upon the socket lip section 41 and then into the socket itself, as shown in FIG. 4E. With the reel axle now captured by the socket, further advancement of the conveyor causes the arm 35 to pull the reel along the track 20 with the reel axle rotating freely within the bounds of the socket.

With the reel 50 now being pulled by a pair of the arms 35 it is drawn upwardly upon track 20 and then pulled sequentially through vats 11–14 to the reel discharge station 30. As this is done it is seen that the reel moves upon a serpentine track provided, at least in part, by the walls and bottom of the vats themselves and innerconnecting surfaces at their junctures, as well as the more defined tract 20. Thus, a serpentine track is provided by a combination of defined U-shaped track members as well as portions of the vats themselves. If desired, other U-shaped tracks 20 may be mounted within the confines of one or more of the vats above the vat bottom to regulate the degree of submergence.

Figure 5A:
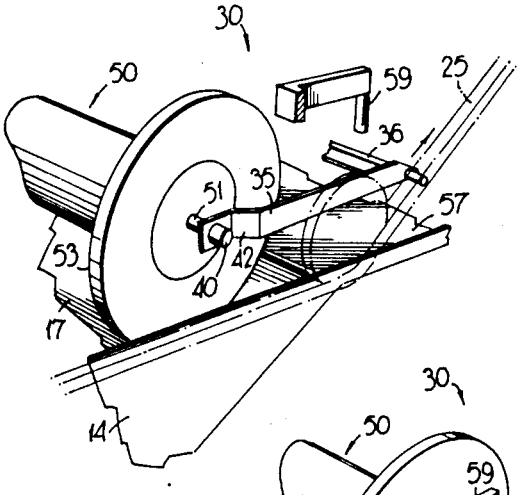
FIGS. 5A–5C illustrate, in perspective, a portion of a reel passing sequentially through a reel discharge station of the apparatus where the pickup arm is released from the reel.
Figure 5B:
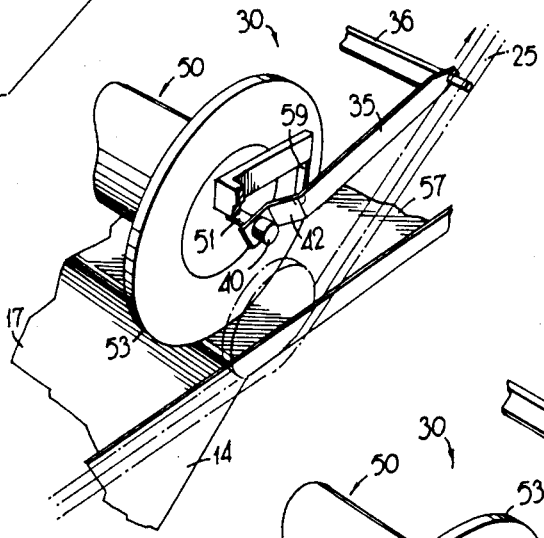
Figure 5C:
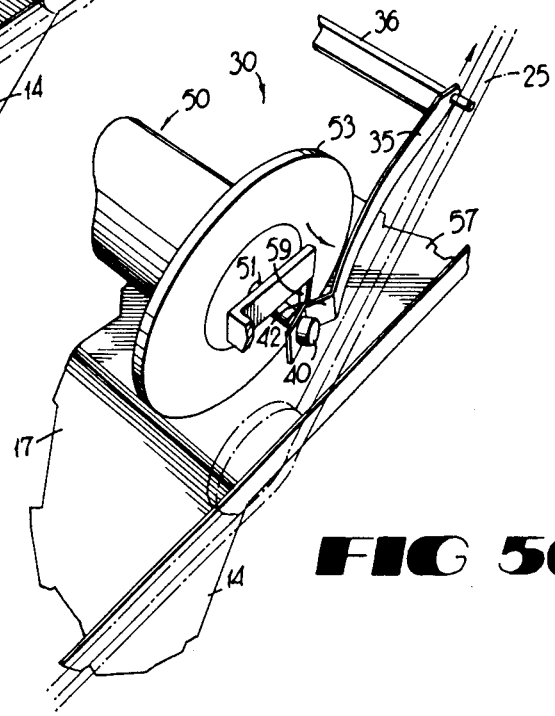

With reference next to FIGS. 5A–5C, the manner in which a reel is released from the conveyor at the reel discharge station 30 is sequentially illustrated. In FIG. 5A the grab arm 35 is seen to have now entered the reel discharge station where a cam bar 59 is rigidly mounted to frame 10 along the path of travel of the arm intermediary section 42. The reel here is in the process of being raised upon the end wall 17 of vat 14 which wall merges with a generally horizontal planar track section 57 mounted to the frame 10. In FIG. 5B the arm 35 is seen to have advanced further into the station and pivot pin 36 raised along an inclined path of travel section of the conveyor chains 25. Continued movement of the arm 35 here brings the intermediary camming section 42 into contact with the camming bar 59 which commences to flex the arm away from the reel. In FIG. 5C the arm is seen to have become flexed to a degree withdrawing its socket 40 from about the end of the reel axle. The arm is thus now free to continue upwardly and the reel is now free to roll to the end of the track section 57 under its own momentum. Each pair of arms 35, following release, become free to swing downwardly from the conveyor chain as it moves along its upper path of return travel 27 back to the pickup station, but in actuality here slides in a horizontal orientation upon a member of the frame.

Figure 3:
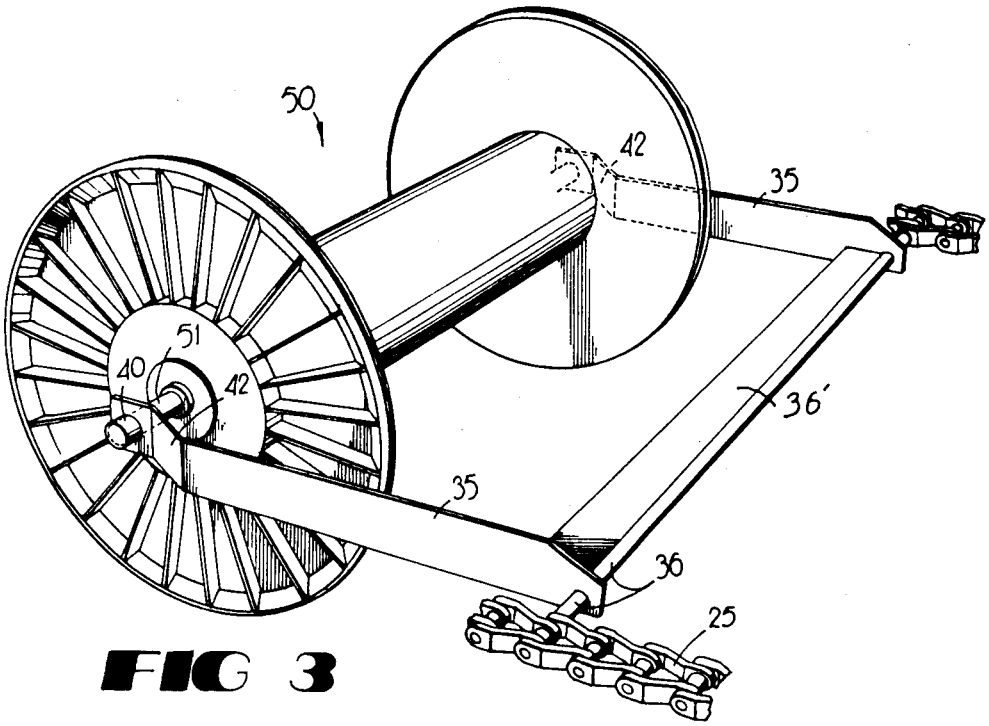
FIG. 3 is a perspective view of a reel being pulled by a pair of arms mounted to a conveyor component of the apparatus.

It thus is seen that an apparatus and method is now provided for cleaning reels on an automated basis wherein axial projections of the reel are grabbed by pairs of resilient arms pivotably mounted to an endless conveyor. The arms serve to pull the reels along a serpentine path of travel through a succession of vats where the reels are degreased, brightened, and rinsed. As this is done the grab arms oscillate irregulary as they pull the reels successively through the series of tanks. Since the ends of the reel axles are loosely captured within the arm sockets, they are free to rotate. Where the reels are provided with radial fins on their flanges, as shown in FIG. 3, the rotation of these flanges within the liquid bodies of cleansing agents serves to agitate the agents and thereby provide enhanced cleaning. In some of the tanks the cleansing agents are bodies of liquid while in the others a spraying action is performed. At the reel discharge station the reels are automatically released from the grab arms without need for any manual assistance.

It should be understand that the just described embodiment merely illustrates principles of the invention in one preferred form. Many modifications, additions and deletions may, of course, be made thereto without departure from the spirit and scope of the invention as set forth in the following claims.

We claim:

1. Apparatus for cleaning reels comprising a plurality of vats mounted in tandem in which a plurality of liquid cleansing agents may be separately applied to reels; conveyor means extending along said vats; at least one pair of resilient arms mounted to said conveyor means provided with arm sockets facing one another and spaced apart a distance for holding opposite ends of an axle of a reel located therebetween and being further provided with camming surfaces for spreading said resilient arm sockets apart upon contact with the reel axle and for releasing them so as to capture the axle ends at a reel pickup station and for spreading said resilient arm sockets apart upon contact with camming means at a reel discharge station so as to release them from the axle ends at a reel discharge station.

2. The reel cleaning apparatus of claim 1 wherein said conveyor means comprises a pair of endless chains mounted for travel along two parallel, looped paths over said plurality of vats.

3. The reel cleaning apparatus of claim 2 wherein said arms are pivotably mounted to said chains.

4. The reel cleaning apparatus of claim 1 wherein each of said vats has inclined walls over which reels may be rolled in following a serpentine path of travel sequentially through said plurality of vats while driven by said conveyor means between said reel pickup and reel discharge stations.

5. Apparatus for cleaning reels of a type having projections extending outwardly from their flanges comprising at least one vat adapted to receive a liquid cleansing agent, conveyor means extending along a pth of travel adjacent said vat; at least one arm suspended from said conveyor means provided with a socket for holding an end of a reel projection, a stop bar mounted at said pickup station to engage said arm as it is conveyed through said pickup station by said conveyor means and to guide said arm socket into axial alignment with the reel projection while the reel is located at the pickup station for capturing and holding the projection, and another bar mounted at a reel discharge station to engage said arm as it is conveyed through said discharge station and cam it axially outwardly from the reel so as to release said arm socket from the reel projection.

6. The reel cleaning apparatus of claim 5 wherein said vat is one of a series of vats mounted in tandem, and wherein said conveyor means comprises an endless conveyor chain that extends along a generally linear path of travel adjacant said series of vats.

7. The reel cleaning apparatus of claim 6 wherein said arm is pivotably suspended from said conveyor whereby the arm may pivot upwardly and downwardly as it pulls the reel into and out of the vats of said series of vats.

8. Apparatus for cleaning reels comprising a set of vats arranged in tandem and having serpentine track means upon which reels may be rolled sucessively therethrough, endless conveyor means extending along said set of vats, and grab arm means pivotably suspended from said conveyor means for drawing reels successively through said vats upon said serpentine track means, said grab arm means being provided with sockets adapted to hold opposite ends of axial reel projections, and means for guiding said grab arm means sockets into and out of position holding the reel projections.

9. A method of cleaning reels comprising the steps of positioning a reel at a reel pickup station located at one end of a series of vats arranged in tandem along which an endless conveyor chain is driven, bringing a pair of pickup arms pivotably suspended from the conveyor chain into engagement with projections that project coaxially outwardly from the flanges of the reel, drawing with the pair of arms the reel from the pickup station successively through the vats while applying liquid cleansing agents to the reel while passing through each vat, and disengaging the pickup arms from the reel projections at a reel discharge station located at the opposite end of the series of vats.

10. The reel cleaning method of claim 9 wherein sockets on the ends of arms distal the conveyor chain are positioned about the reel projections at the pickup station and removed from about the reel projections at the reel discharge station.

11. The reel cleaning method of claim 10 wherein the arm sockets are positioned loosely about the reel projections and the reel is rotatably drawn through the vats.

* * * * *